United States Patent [19]

Sherman

[11] Patent Number: 4,967,478

[45] Date of Patent: Nov. 6, 1990

[54] PERSPECTIVE BOW SIGHT

[76] Inventor: Bradley G. Sherman, 2020 Waterford Dr., Coralville, Iowa 52241

[21] Appl. No.: 326,291

[22] Filed: Mar. 20, 1989

[51] Int. Cl.[5] ..... F41G 1/467; F41G 1/42

[52] U.S. Cl. ..... 33/265; 124/87

[58] Field of Search ..... 33/265, 251, 252, 254, 33/297, 298; 124/87, 88

[56] References Cited

U.S. PATENT DOCUMENTS

| | | | |
|---|---|---|---|
| 1,353,151 | 9/1920 | Deming | 33/251 |
| 2,208,576 | 7/1940 | Garand | 33/254 |
| 2,825,137 | 3/1958 | Meetin | 33/252 |
| 3,190,003 | 6/1965 | O'Brien | 33/297 |
| 3,234,651 | 2/1966 | Rivers | 33/265 |
| 3,284,904 | 11/1966 | Rade | 33/265 |
| 3,289,300 | 12/1966 | Jordan | 33/265 |
| 3,455,027 | 7/1969 | Perkins | 33/265 |
| 3,499,224 | 3/1970 | Squier et al. | 33/252 |
| 3,715,807 | 2/1973 | Heffer | 33/265 |
| 3,811,195 | 5/1974 | Carella | 33/265 |
| 3,997,974 | 12/1976 | Larson | 33/265 |
| 4,215,485 | 8/1980 | Mesler | 124/87 |
| 4,237,615 | 12/1980 | Bracknell | 33/265 |
| 4,291,469 | 9/1981 | Weast | 124/87 |
| 4,528,973 | 7/1985 | Rasmussen | 33/265 |
| 4,625,420 | 12/1986 | Figured | 33/265 |

OTHER PUBLICATIONS

"Bow and Arrow" Dec. 1986, p. 44.

*Primary Examiner*—William A. Cuchlinski, Jr.
*Assistant Examiner*—Christopher W. Fulton

[57] ABSTRACT

An aiming device for archery bows comprising a non-sight restricting tube, the said tube housing a front cross-hair sight and a rear multiple range compensating rear peep sight; the said tube being detachably secured to a mounting and adjusting apparatus which is secured to the standard mounting point on most standard bow handles.

5 Claims, 6 Drawing Sheets

PERSPECTIVE BOW SIGHT

FIELD OF INVENTION

The field of this invention relates to aiming or sighting devices for archery bows.

The concept of a non-optical tube type sight comprising front and rear sights located in the tube is not new to archery sighting devices. Prior patents such as U.S. Pat. No. 2,351,103 issued to O. H. Brown on June 13, 1944 and U.S. Pat. No. 3,284,904 issued to D. B. Rade on Nov. 15, 1966 both contain the basic concept. However, these sights create considerable restriction of view to the archer when sighting due to the visual effect of "narrowing" which occurs when looking through a tube which has a constant diameter. These sights also consist of many parts therefore being bulky and expensive to manufacture, neither do these sights mount readily to modern bows.

U.S. Pat. No. 3,997,974 issued to Marlow W. Larson on Dec. 21, 1976 is also a tube type sight but it also has the negative features.mentioned above as well an extensive apparatus which does not apply to the here in disclosed bow sight.

U.S. Pat. No. 3,488,853 issued to A. L. Altier on Jan. 13, 1970, U.S. Pat. No. 3,648,376 issued to Willian J. Millnamow on Mar. 14, 1972, and U.S. Pat. No. 4,570,352 issued to Manuel J. Leal on Feb. 18, 1986 all three incorporate the concept of front and rear sights positioned on a major axis, but neither are readily attachable to modern bows and neither completely enclose the front and rear sights to protect it from damage or being jarred from alignment should the bow be dropped or bumped into objects encountered in hunting etc.

Still other sights have short tubes but the tubes are not long enough to be considered tubes but rather are more like rings containing cross hairs or bead-type sight pins mounted in them and do not incorporate both the front and rear sight in the same sight body housing (tube). Such tubes are shown in the drawings of U.S. Design Pat. No. D260,417, issued to August E. Siekman on Aug. 25, 1981 and U.S. Pat. No. 4,541,179 issued to Robert A. Closson on Sept. 9, 1985.

Still other sights which have very little similarity, if any, to the disclosed sight, utilize multiple sighting pins with beads on their ends such as U.S. Pat. No., 4,026,032 issued to Jimmie Thomas Smith on May 31, 1977 and U.S. Pat. No. 4,625,421 issued to Juergen M. Strauss on Dec. 2, 1986. These pins serve as front sights either with or without some sort of rear sight and can be difficult to use in a hurried situation because of choosing the wrong sight pin. These multiple pins are also very susceptible to damage even when the standard guards are utilized.

SUMMARY AND OBJECTS OF THE INVENTION

This invention relates to archery bow sights and comprises a sight body tube which increases in diameter from one end to the other, a front and rear sight housed in said tube, and a mounting system for securing said sight to an archery bow. The disclosed sight provides an aiming apparatus which is effective in not only a controlled environment such as target shooting but is very effective in an uncontrolled environment such as occurs when hunting.

The disclosed bow sight comprises a tube which houses a delicate front and rear sight, the distance between the two sights being sufficient (9–11 inches suggested) to provide for accurate aiming while the overall length of the said tube is short enough so as to not be bulky. When no rear sight is employed with a front sight, consistant form in shooting stance and posture is essential for accuracy. It is therefore one object of this invention to provide a sight which allows accurate shooting of a bow and arrow even if the archer has not developed consistant form or must shoot from an unplanned stance or position such as happens when trying to shoot around or between tree limbs.

The small end of the increasing diameter or cone-shaped tube being nearest the eye, the archer can see clearly the target while aligning the front and rear sights without a restricted field of view such as the case when trying to locate an object though a tube which is the same diameter along its entire length. Therefore, another object of this InventIon Is to provide a bow sight housing which does not restrict view therefore allowing a shooter to locate a target quickly and easily such is the case when shooting wild game.

The front sight of the disclosed sight is a cross hair mounted in the front of the said tube, yet recessed approximately ¼ inch and a rear peep sight also recessed therefore protecting both front and rear sights from being broken or jarred out of alignment by objects often encountered in hunting situations.

It is therefore another object of this invention to provide a rugged yet accurate sight which is needed in a hunting bow sight on today's market.

The said peep sight is of novel design, having a vertically elongated opening, which provides for range indicating marks which are readily accessible to view while simultaneously aligning the front cross hair in the peep sight opening. There is only one opening in the peep sight through which to align the front sight therefore another object of this invention is to eliminate confusion which often occurs with multiple sight sighting devices.

The disclosed sight also includes a mount system comprising a mount plate made of a flat plate having non-threaded openings for attaching the said mount plate to the standard mounting pad provided on bow handles by most bow manufactures. The said mount plate is designed to be inverted and reversed providing multiple levels of attachment for the sight in reference to the bow handle and providing for use on either right hand or left hand bows.

It is therefore another object of this invention, to provide a bow sight which can be used on either a right hand or a left hand bow while being very versatile in adjustment to suit the comfort of the individual shooter, and provide multiple positions of mounting so as not to interfere with existing equipment such as cable guards and arrow quivers which also attach to the bow handle in the same vicinity.

The means for adjustment of the sight is also included in the mount system therefore it is another object of this invention to provide a bow sight with a mount and adjustment mechanism located on the opposite side of the bow handle from the sighting side of the bow handle therefore adding to the balance of the sight and adding to the clear field of view already provided by the application of the perspective design of the sight body tube.

It is another object of this invention to provide a bow sight which is simple in design and inexpensive to manufacture therefore meeting a need for an inexpensive sight of this type on today's market.

Further objects of this invention will appear as the description proceeds in connection with the appended claims and the below described drawings.

DESCRIPTION OF THE PREFERRED EMBODIMENTS

Figure 1:
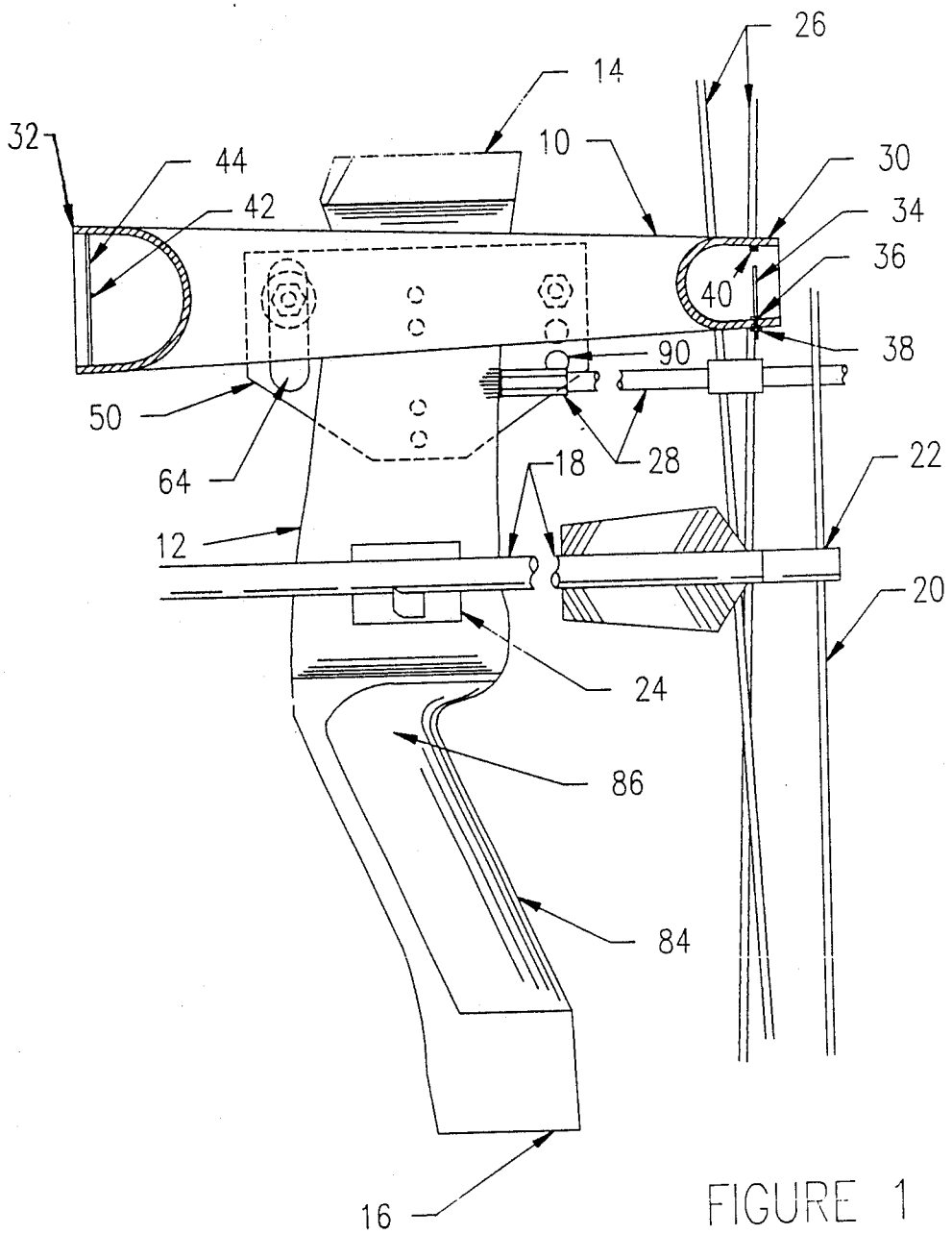
FIG. 1 is a left side elevation of a right hand archery bow with the disclosed bow sight mounted on it. The sight body tube portion of the drawing having cut-away portions on both ends revealing the front and rear sights
Figure 2:
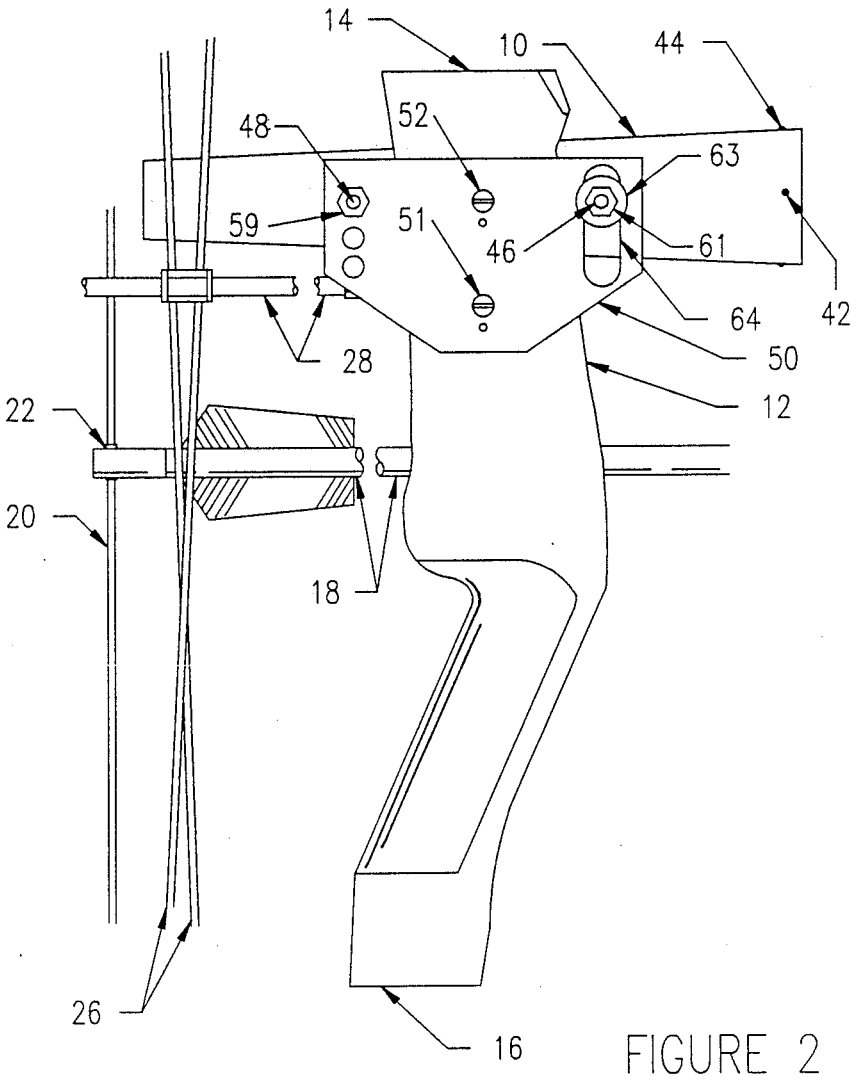
FIG. 2 is a right side elevation of a right hand archery bow with the disclosed sight mounted on it revealing the mount portion of said sight.

Referring to FIG. 1 and 2, the sight body tube 10 is shown to be detachably secured to the central portion of a common right hand compound bow handle 12. Shown is the upper portion of the bow handle 14 and lower portion of the bow handle 16 to which flexible limbs are commonly attached. Also shown is an arrow 18 nocked on the bowstring 20 which has a set nocking position 22 and the arrow resting on the arrow rest 24. Also shown are the cables 26 and the cable guard 28 which is found on many compound bows. It should be noted that the rear of the sight body tube 30 is smaller than the front of the sight body tube 32 causing the sight body tube to be cone-shaped. This concept is referred to as the perspective principle in this disclosure and is illustrated further in FIG. 5.

Figure 6A:
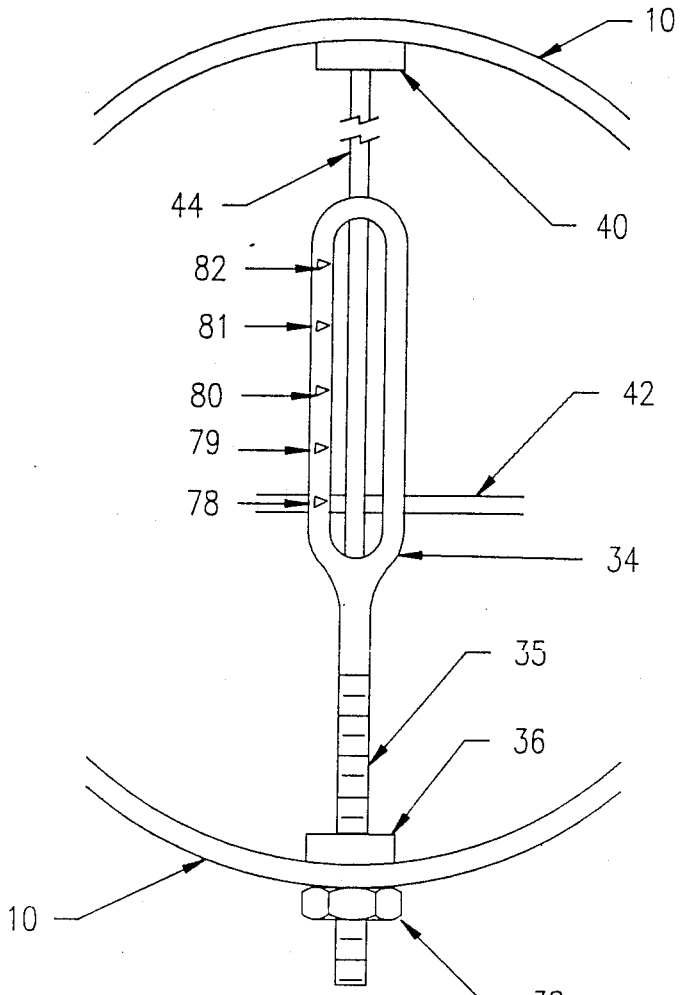
FIG. 6*a–b* is an enlarged view of the rear sight with the front sight in the background illustrating the multiple-range use of the said rear sight.

A cut-away view of both ends of the sight body tube 10 is illustrated in FIG. 1 revealing the rear peep sight 34 mounted in the bottom of the sight body tube 10 through a threaded hole known as the right hand peep sight mounting hole 36 and is locked in place by lock nut 38 which is shown enlarged in FIG. 6*a*. The left hand peep sight mount hole 40 is shown in the top near the small end of the sight body tube 10. As indicated by its name, the left hand peep sight mount hole 40, is used when the disclosed bow sight is used on a left hand bow therefore ending up on the bottom of the sight body tube 10. The horizontal cross hair 42 and the vertical cross hair 44 are revealed by the cut-away view in the front of the sight body tube 10.

Figure 3:
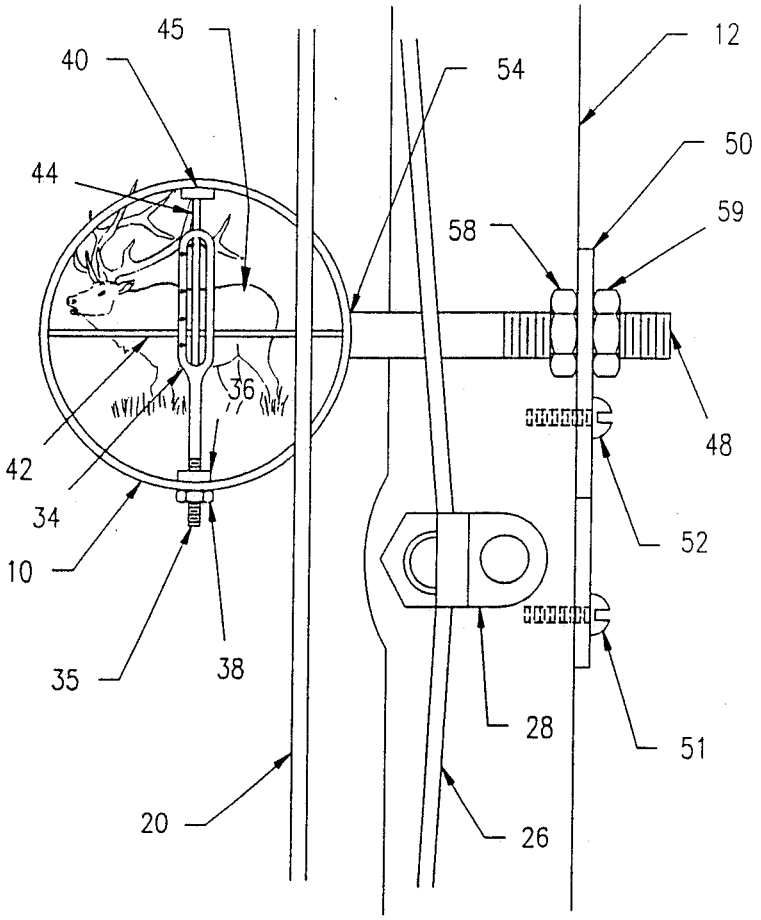
FIG. 3 is a rear elevation of disclosed bow sight mounted on a right hand archery bow as seen by the archer when aiming.
Figure 4:
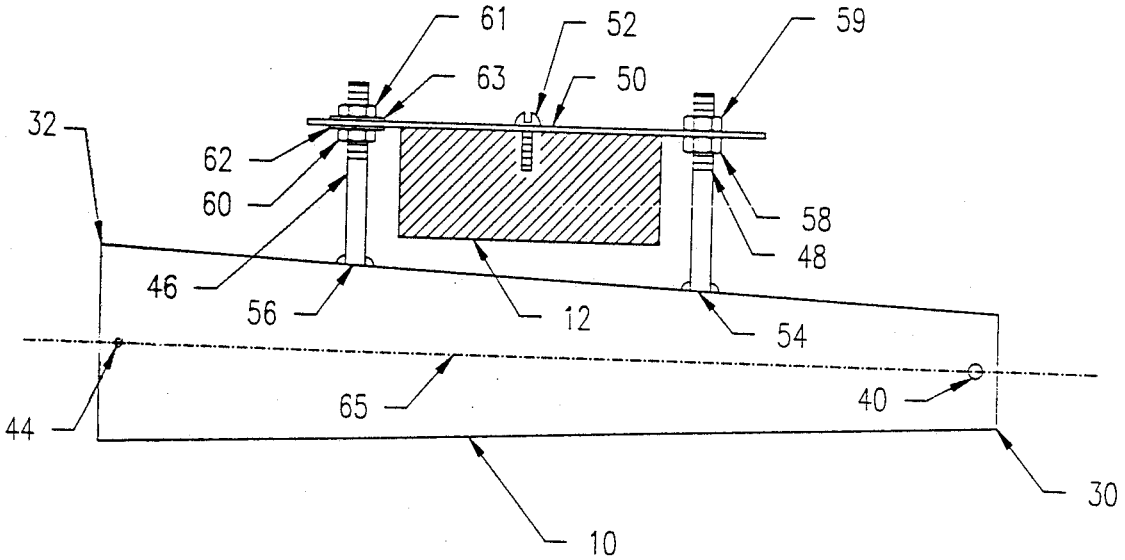
FIG. 4 is a top view of the disclosed bow sight shown mounted on a cross section of the central part of the bow handle.

Shown clearly in FIG. 2, 3, and 4 are the front sight body mount member 46 and the rear sight body mount member 48 which passes through the mount plate 50 which is detachably secured to the central portion of the bow handle 12 by means of two mount plate screws 51 and 52. The sight body mount members 46 and 48 are attached to the sight body tube 10 at points 54 and 56. The sight body mount members 46 and 48 are detachably secured to the mount plate 50 by four nuts 58, 59, 60, and 61 which are best illustrated in FIG. 4. Also included on the front sight body mount bolt 46 are flat washers 62 and 63 which extend beyond elevation adjustment slot 64 and provide a flat surface for nuts 60 and 61 to effectively lock the front sight body mount member 46 into place (also see FIG. 8, 9*a*, and 9*b*).

By changing the position of nuts 58, 59, 60, and 61 the sight body 10 can be moved closer to or farther from the bow handle 12 to suit the individual archer and also providing effective means whereby to adjust windage of the sight by adjusting rear nuts 58 and 59 differently that nuts 60 and 61 thereby causing the sight line 65 to be adjusted from side to side. Elevation can be adjusted by slightly loosening nuts 59, and 61, thereby allowing front sight body mount member 46 to be elevated or lowered through elevation adjustment slot 64 while rear sight mount member 48 acts as a pivot. Then nut 61 can be tightened when the correct elevation in aiming is obtained. Then nut 59 is also tightened to create a very solid and rugged mount for the sight body tube 10.

Figure 5:
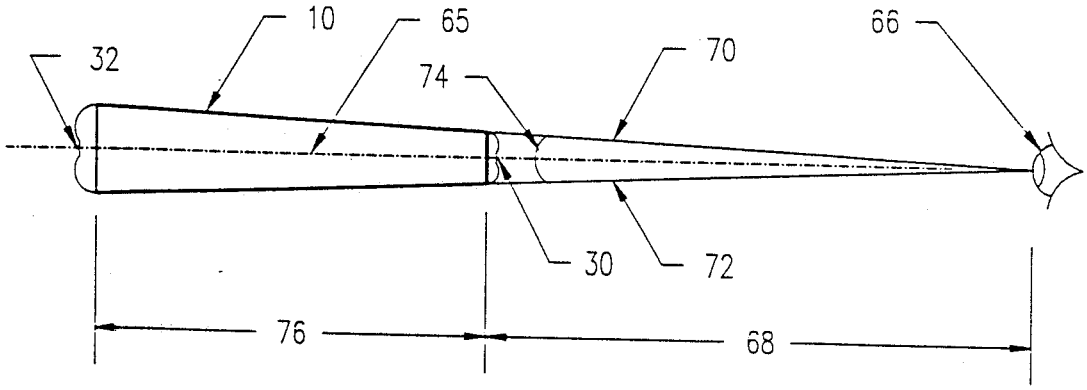
FIG. 5 is a diagram illustrating the perspective principle as a means of determining the rate of expansion of the sight tube.

In FIG. 5, the unique application of the perspective principle to the shape of the sight body tube 10 is illustrated. The object is to obtain a tube which increases in diameter at the correct rate as the measured distance from the archer's eye 66 is increased by the length of the said tube thus eliminating the "narrowing effect" also known as tunnel vision. This "narrowing effect" is the result of looking through a tube with a constant diameter along its entire length thus obstructing a portion of the archer's view of the target. The distance from the shooter's eye 66 to the small end of the sight body tube 30 is known as eye relief 68. For example; using a scale diagram patterned after FIG. 5, the eye relief distance 68 being established at 23 ½ inches and the diameter of the small end of the sight body tube 30 being established at 1 ¾ inches, the angle of expansion 74 can be measured to be approximately 5 degrees. When the degree of expansion 74 is established by first establishing eye relief distance 68 and establishing the small end of sight body tube diameter 30, the diameter of the large end of the sight body tube then depends upon the length of distance 76 which is the length of the sight body tube 10. Using the example distances above, and if distance 76 was 10 inches, the diameter of the large end of the sight body tube would be approximately 2 ½ inches. By finding an average eye relief distance 68 this principle can be used as a means to manufacture a tube-type bow sight which causes very little restriction to the view of the hunter while housing thus protecting the delicate cross hairs, 42 and 44, and the peep sight 34. This principle can also be used as a means to manufacture a custom sight based on the exact eye relief of a specific archer.

FIG. 3 illustrates what the archer sees when aiming through the disclosed bow sight. The result is an unobstructed view of the target 45, the tube appearing only as a thin ring.

Figure 6B:
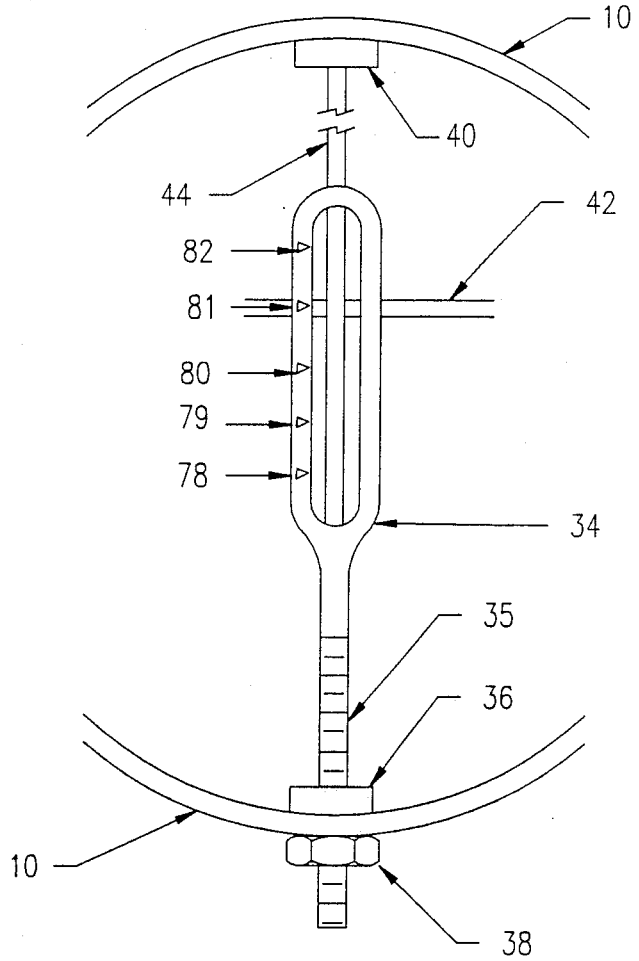

FIG. 6*a–b* is an enlarged view of the novel design of the multiple range peep sight 34. The peep sight 34 includes a threaded post 35 which provides support and a means of attaching the peep sight to the sight body tube 10. The peep sight is shown with distance markings 78, 79, 80, 81, and 82.

In FIG. 6a, the horizontal cross hair 42 is shown in line with the first distance mark 78. This mark represents close range shooting, possibly a 10 yard mark. Each of the other distance marks, 79, 80, 81, and 82, then represents a sighting reference mark for a target a greater distance away, possibly in 10 yard increments. FIG. 6b illustrate the horizontal cross hair 42 aligned with distance marker 81, which would therefore represent proper elevation compensation for a target 40 yards away. The change in sight positioning is achieved when the archer, after having drawn the bow string 20 to full draw and gripping the bow at the grip 84, simply raised or lowers his hand which is gripping the nocking point 22 (see FIG. 1). Raising or lowering the nocking point 22 creates a pivot point at or near point 86. The action of lowering the nocking point 22 with point 86 being a pivot, causes the cross hairs 42 and 44 to raise and the peep sight 34 to move downward in relation to the line of sight 65 resulting in the change in view from FIG. 6a to FIG. 6b, therefore aiming the arrow 18 along a trajectory which compensates for the proper distance to a target. The distance marks 78–82 can be attached to the peep sight in various ways. A small strip of adhesive paper or plastic upon which distance marks can be recorded, small adhesive dots of paper or plastic, spots of paint, or moveable clips being a few.

Figure 7:
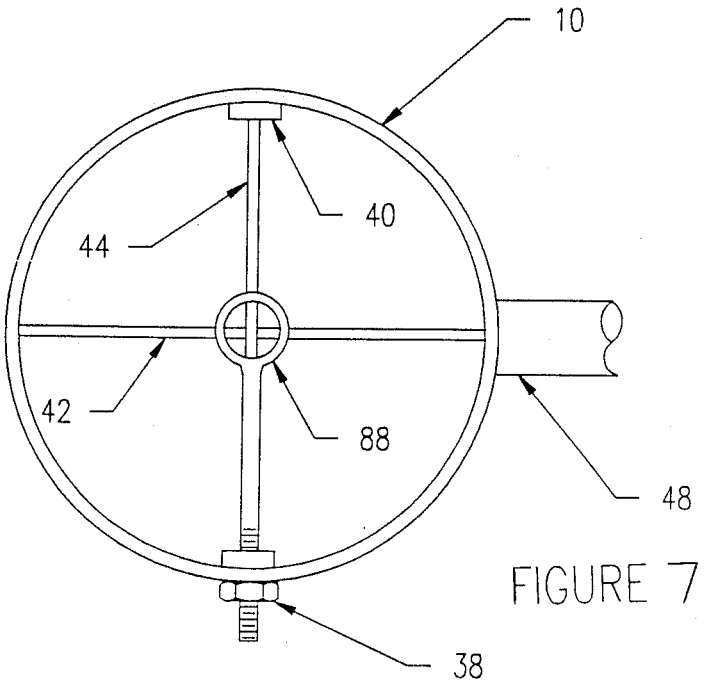
FIG. 7 is a rear view of the disclosed sight body tube showing the use of an optional single range rear sight design.

FIG. 7. illustrates the versatility of the disclosed sight using a single range peep sight 88 shown mounted in sight tube 10 for those archers who prefer it.

Also shown in FIG. 1, 2, 3, 4, 8, 9a, and 9b, is the mounting plate 50. Referring to FIG. 2, the mounting plate 50 is clearly seen from the opposite side of FIG. 1. The mounting plate 50 is detachably secured to the central Portion of the bow handle 12 by two mounting screws 51 and 52.

Figure 8:
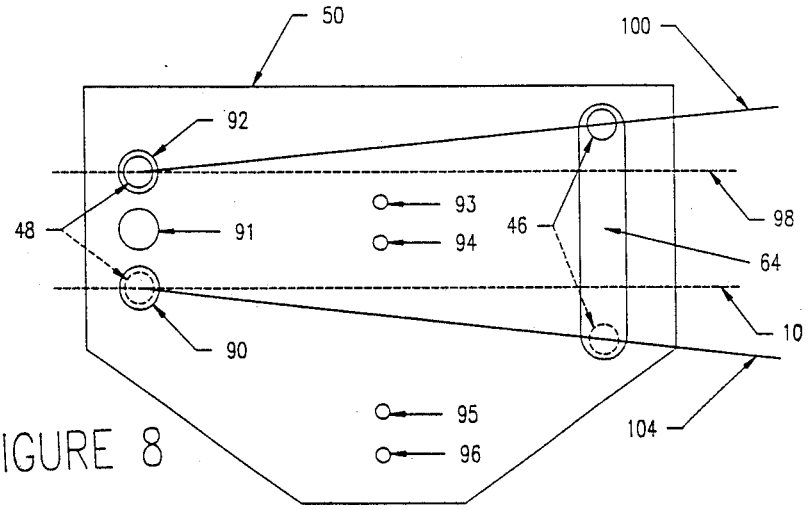
FIG. 8 is a diagram of the mounting plate portion of the disclosed bow sight illustrating its design.

In reference to FIG. 8, the design of the mounting plate 50 is illustrated showing the elevation adjustment slot 64, the front sight-body mount member 46, the rear mount member holes 90, 91, and 92, and the rear sight mount member 48. Also illustrated are two sets of mount plate attachment holes 93–96. One set consisting of 93 and 95 and the other set consisting of 94 and 96. The rear sight body mount member 48 is shown in hole 92 with the front sight body mount member 46 in the elevation adjustment slot 64. The elevation adjustment slot 64 extends vertically past the horizontal parallel lines 98 and 102. This provides for the adjustment range of the sight line 65 to extend beyond horizontal in either direction whether mount hole 90 or 92 is used. If mount hole 91 is used, adjustment beyond horizontal is obviously sufficient.

In reference to FIG. 8, when the rear sight body mount member 48 is mounted in hole 90, the sight line 65 is represented by line 104 and when rear sight body mount member 48 is in hole 92, sight line 65 is represented by line 100. Note that the elevation adjustment slot 64 has a width sufficient to allow free movement of the front sight body mount member 46 regardless of the position of the rear sight body mount member 48 whether in hole 90, 91 or 92.

It should be noted that the mount plate 50 provides points of attachment for the front sight body mount member 46 (in slot 64) to be separated horizontally from the points of attachment for the rear sight body mount member 48 (holes 90, 91, 92) by a distance sufficient to allow members 46 and 48 to be located one forward of the bow handle 12 and the other behind the bow handle 12. This provides a sturdy attachment and allows the rear mount member 48 to be a pivot for the movement of the front mount member 46 through the elevation adjustment slot 64.

Figure 9A:
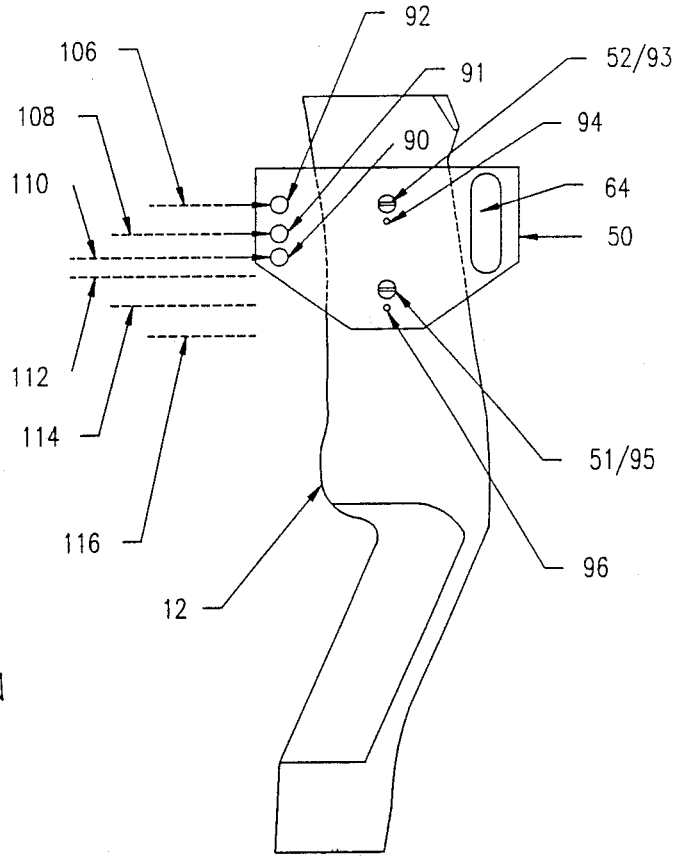
FIG. 9*a–b* is a diagram of the mounting plate portion of the disclosed bow sight shown attached to the handle of an archery bow further illustrating its versatility.
Figure 9B:
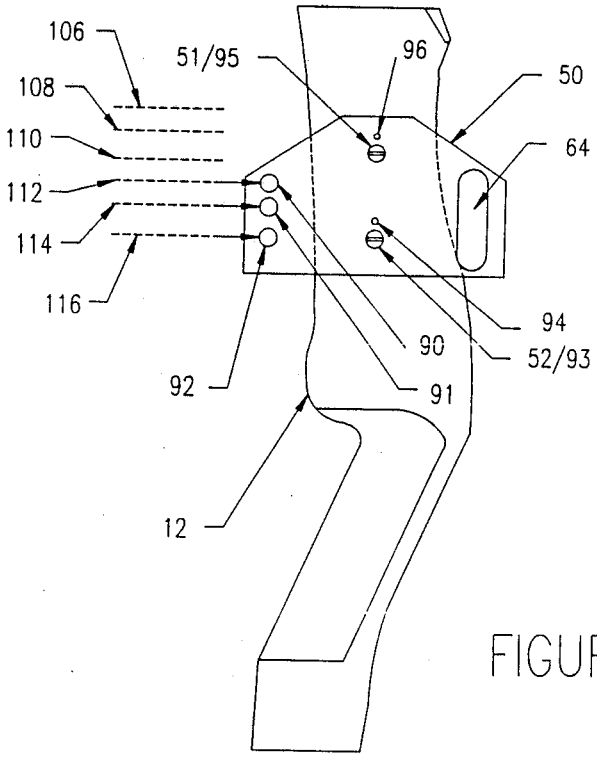

FIG. 9 illustrates the versatility of the mount plate 50 by showing the mount plate 50 attached to the bow handle 12 in an upward position in FIG. 9a and inverted to a downward position in FIG. 9b. Lines 106, 108, 110, 112, 114, and 116 represent different levels on which the sight body tube 10 can be mounted.

The set of Mount plate attachment holes used in FIG. 9a and in FIG. 9b is hole 93 and hole 95. Should mount plate attachment hole set 94 and 96 be used, the distance between line 110 and line 112 would be increased therefore creating six slightly different levels than levels 106–116 adding up to a total of twelve different levels providing further versatility. This versatility is useful for fitting the individual archer's comfort and for providing attachment of the disclosed bow sight to the bow without interfering with other equipment and mechanisms such as the cable guard 28 (see FIG. 1, 2, and 3). Means for using the mount plate 50 on either a right hand or left hand bow is provided by the fact that the said mount plate is smooth on both sides; therefore it can be reversed for use on either.

What is claimed is:

1. An archery bow sight comprising:

(a) an infundibularly shaped sight body having a front end and a rear end, the rear end being positioned nearest to an eye of a person peering through the sight and having the smallest diameter of the two ends, the inside diameter and the outside diameter of the said sight body increasing simultaneously and parallel with each other from the rear end to the front end such that the field of view is not restricted by the sight body;

(b) two rear sight attachment points in the small end of the sight body located vertically 180 degrees apart with respect to one another, thereby providing a means for use of said bow sight on either a right-hand or left-hand bow;

(c) a mount plate for the purpose attaching said bow sight to an archery bow.

2. The bow sight according to claim 1 further comprising a means of multiplying by two, the number of vertical positions of attachment of the sight body in relation to the bow handle by inverting or turning upside down the said mounting plate in its attachment to the bow handle.

3. An archery bow sight, comprising:

(a) an infundibularly shaped sight body having a front end and a rear end, the rear end being the end positioned closest to an eye of a person peering through the sight while aiming and having the smaller diameter of the two ends;

(b) perpendicularly oriented cross hair members positioned at an opening at the front end of the sight body;

(c) a peep sight member mounted within the sight body, the peep sight member including an opening which aligns with a cross point of the cross hair members along the line of sight of the person aiming and a plurality of range marks located adjacent the opening; and (d) means for mounting the sight on an archery bow.

4. The archery bow sight according to claim 3, wherein the diameter along the sight body is determined such that the field of view of the person aiming is not restricted.

5. The archery bow sight according to claim 3, wherein the peep sight member opening is elongated along a vertical axis.

* * * * *